US012366062B2

(12) United States Patent
Cao et al.

(10) Patent No.: US 12,366,062 B2
(45) Date of Patent: Jul. 22, 2025

(54) MODULARIZED INDUCTION FLUSHING DEVICE FOR URINAL AND INDUCTION URINAL

(71) Applicant: Lixil (China) Investment Co., Ltd., Shanghai (CN)

(72) Inventors: Dan Cao, Shanghai (CN); Heqing Jiang, Shanghai (CN); Jianjian Gao, Shanghai (CN); Junyan Xu, Shanghai (CN)

(73) Assignee: LIXIL (China) Investment Co., Ltd., Shanghai (CN)

( * ) Notice: Subject to any disclaimer, the term of this patent is extended or adjusted under 35 U.S.C. 154(b) by 305 days.

(21) Appl. No.: 18/128,472

(22) Filed: Mar. 30, 2023

(65) Prior Publication Data

US 2023/0313515 A1 Oct. 5, 2023

(30) Foreign Application Priority Data

Mar. 31, 2022 (CN) ..... 202220799825.4

(51) Int. Cl.
*E03D 5/10* (2006.01)
*E03D 13/00* (2006.01)

(52) U.S. Cl.
CPC ..... *E03D 5/105* (2013.01); *E03D 13/00* (2013.01)

(58) Field of Classification Search
CPC ..... E03D 5/105; E03D 13/00
USPC ..... 4/301
See application file for complete search history.

(56) References Cited

U.S. PATENT DOCUMENTS 3,751,736 A * 8/1973 Egli ..... E03D 13/00 4/305
5,054,132 A * 10/1991 Bartella ..... E03D 5/04 4/313
2010/0088812 A1* 4/2010 Chen ..... E03D 13/00 4/301

(Continued)

*Primary Examiner* — Huyen D Le
(74) *Attorney, Agent, or Firm* — Anna-Lisa L. Gallo; Tyler A. Stevenson

(57) ABSTRACT

The present utility model provides a modularized induction flushing device for a urinal and an induction urinal. The modularized induction flushing device comprises a water inlet and outlet assembly, a water drainage assembly, an electromagnetic valve assembly, and a power supply assembly, wherein the modularized induction flushing device further comprises an induction module, the induction module is associated with the electromagnetic valve assembly and is attached to the water inlet and outlet assembly and/or the water drainage assembly, wherein the induction module is configured to be switched between at least two induction modes in a replaceable mode, and the electromagnetic valve assembly responds to different induction modes of the induction module to control flushing of the urinal. According to the modularized induction flushing device of the present utility model, the replaceable induction module is provided, the induction modes can be switched according to different needs, the use experience of a user is improved, the modularized induction flushing device is easy to implement, the performance is obviously improved, the modularized induction flushing device can be applied to various occasions, and the diversified requirements of the user are met.

18 Claims, 11 Drawing Sheets

(56) References Cited

U.S. PATENT DOCUMENTS

| | | | | |
|---|---|---|---|---|
| 2015/0020298 | A1* | 1/2015 | Hsu | E03D 5/105 4/305 |
| 2015/0292912 | A1 | 10/2015 | Claes et al. | |
| 2015/0330815 | A1* | 11/2015 | Louden | E03D 5/105 73/431 |
| 2019/0010683 | A1* | 1/2019 | Bush | E03C 1/0404 |
| 2020/0347587 | A1* | 11/2020 | Gunawardena | E03D 13/00 |
| 2021/0348376 | A1* | 11/2021 | Yao | E03D 13/005 |
| 2024/0301667 | A1* | 9/2024 | Cummings | E03B 7/071 |

* cited by examiner

MODULARIZED INDUCTION FLUSHING DEVICE FOR URINAL AND INDUCTION URINAL

TECHNICAL FIELD

The present utility model relates to the technical field of urinals, in particular to a modularized induction flushing device for a urinal and an induction urinal with the modularized induction flushing device.

BACKGROUND ART

Generally, in order to realize an automatic flushing function of a urinal after use, a traditional manner is to provide a human body detection inductor on the urinal, so that once a human body or object approaches the urinal, the inductor is triggered to operate and achieve flushing. Although a variety of inductive trigger manners have been developed, there is still much room for improvement for different application environments and specific needs of different users.

SUMMARY OF THE UTILITY MODEL

The purpose of the present utility model is to provide a modularized induction flushing device. When applied to a urinal, the modularized induction flushing device may achieve the assembly and/or replacement of modularized assemblies based on different application environments and/or different user needs, thereby achieving diversified applications of products in a cost-effective and convenient manner, and improving the user experience and satisfaction.

Therefore, according to one aspect of the present utility model, a modularized induction flushing device for a urinal is provided. The modularized induction flushing device comprises a water inlet and outlet assembly, a water drainage assembly, an electromagnetic valve assembly, and a power supply assembly, wherein the modularized induction flushing device further comprises an induction module, the induction module is associated with the electromagnetic valve assembly and attached to the water inlet and outlet assembly and/or the water drainage assembly, wherein the induction module is configured to be switched between at least two induction modes in a replaceable manner, and the electromagnetic valve assembly responds to different induction modes of the induction module to control flushing of the urinal.

According to the above technical concept, the embodiments of the present utility model may further comprise any one or more of the following alternative forms.

In some alternative forms, the induction module comprises at least two of an infrared induction assembly, a conductance induction assembly, and a capacitive induction assembly.

In some alternative forms, the water inlet and outlet assembly comprises a water inlet pipe connected with the electromagnetic valve assembly, a water outlet pipe, and a flushing nozzle removably connected with the water outlet pipe, and the flushing nozzle is adapted to be arranged on an upper portion of the urinal and is at least provided with a flushing opening.

In some alternative forms, the infrared induction assembly comprises an infrared induction controller connected with the electromagnetic valve assembly, and an infrared induction probe connected with the infrared induction controller, and the infrared induction probe is attached to the water inlet and outlet assembly.

In some alternative forms, the infrared induction probe is attached to the flushing nozzle, and the flushing nozzle is provided with a slot allowing the infrared induction probe to be exposed.

In some alternative forms, the conductance induction assembly comprises a conductance inductor connected with the electromagnetic valve assembly, and the conductance inductor is adapted to be attached to an inner wall of a back side of the urinal adjacent to the water drainage assembly, and is not in contact with liquid in the urinal.

In some alternative forms, the conductance induction assembly further comprises an inductor bracket, the inductor bracket is provided with a clamping groove for accommodating the conductance inductor, and is attached to the inner wall of the back side of the urinal through an adhesive, the conductance inductor is removably accommodated within the clamping groove through an adhesive, and the inductor bracket has an outer surface fitting with a profile of the inner wall of the back side of the urinal.

In some alternative forms, the capacitive induction assembly comprises a capacitive inductor connected with the electromagnetic valve assembly and electrodes connected with the capacitive inductor, the capacitive inductor is removably bonded to the water drainage assembly, and the electrodes are attached to an outer wall of a water inlet port of the water drainage assembly and are not in contact with the liquid in the urinal.

In some alternative forms, the capacitive induction assembly comprises at least two electrodes arranged in sequence along a water drainage direction.

In some alternative forms, the water drainage assembly further comprises a sealing plug disposed between the outer wall of the water inlet port and a water drainage pipe opening of the urinal, and the sealing plug covers the electrodes.

In some alternative forms, the modularized induction flushing device further comprises a mounting plate adapted to be fixed to a wall, and the water drainage assembly communicates with a sewage pipeline through the mounting plate, wherein the electromagnetic valve assembly, the power supply assembly, and/or the induction module are directly fixed to the inner wall of the back side of the urinal through a bracket, or the bracket is fixed to the mounting plate through a connecting frame.

In some alternative forms, the bracket comprises a bottom board and at least one support board extending out from the bottom board in parallel and/or at an angle, and the support board is provided with a support cantilever and/or a support buckle extending out approximately parallel to the bottom board, so as to be used for fixing the electromagnetic valve assembly, the power supply assembly, and/or the induction module.

In some alternative forms, the connecting frame is configured as a connecting board fixed to the mounting plate in an attached manner, and is provided with a pair of clamping ribs protruding out from the connecting board, the bracket comprises mounting lugs extending out from the bottom board at an angle, and the mounting lugs are adapted to be removably clamped into the pair of clamping ribs.

In some alternative forms, the connecting frame is configured to be in a Y shape and comprises a notch for forming avoidance with the water drainage assembly.

According to another aspect of the present utility model, an induction urinal is provided. The induction urinal comprises a urinal body and the above-mentioned modularized induction flushing device for the urinal, wherein before or after the modularized induction flushing device is assembled to the urinal body, the induction module is attached to the water inlet and outlet assembly and/or the water drainage assembly in a replaceable manner to realize switching of at least two induction modes.

According to the modularized induction flushing device of the present utility model, the replaceable induction module is provided that can switch the induction modes according to different needs and improve the use experience of a user, the modularized induction flushing device is easy to implement, the performance is obviously improved, the modularized induction flushing device can be applied to various occasions, and the diversified requirements of the user are met.

BRIEF DESCRIPTION OF THE DRAWINGS

Other features and advantages of the present utility model will be better understood by the following alternative embodiments described in detail in conjunction with the accompanying drawings, in which the same reference numerals identify the same or similar components, wherein.

DETAILED DESCRIPTION OF EMBODIMENTS

Figure 1:
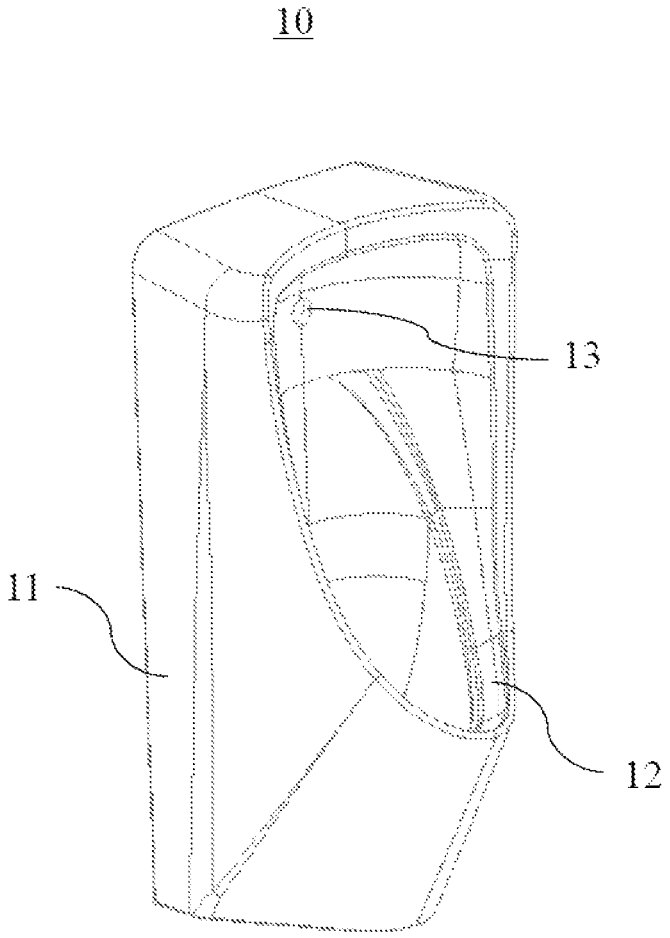
FIG. 1 is a schematic diagram of a urinal body of a urinal according to an embodiment of the present utility model.

The implementation and use of the embodiments are discussed in detail below. However, it should be understood that the specific embodiments discussed are merely illustrative of specific manners to implement and use the present utility model, and are not intended to limit the scope of the present utility model. The expressions of structural positions of various components, for example, "upper," "lower," "top," "bottom," and other directions at the time of description are not absolute, but relative. These expressions for the directions are appropriate when various components are arranged as shown in the drawings, but when the positions of the various components in the drawings are changed, these expressions for the directions are also changed accordingly.

Herein, the expression "comprise" or its synonymous similar expressions "include," "contain," "have," etc. are open-ended and do not exclude additional unlisted elements, steps, or compositions. The expression "consist of" excludes any element, step, or composition not specified. The expression "essentially consist of" means that the scope is limited to the specified elements, steps, or compositions, plus optionally existing elements, steps, or compositions that do not materially affect the basic and novel characteristics of the claimed subject matter. It should be understood that the expression "comprise" encompasses the expressions "essentially consist of" and "consist of."

Herein, unless otherwise clearly and specifically defined, the terms "mount," "connect," "attach," and the like are to be understood in a broad sense, for example, they may be fixed connection, removable connection, or integration; and they may be direct connection or indirect connection through an intermediary, or they may be internal communication of two elements or an interaction relationship between two elements. A person skilled in the art may understand the specific meanings of the above terms herein according to specific situations.

Herein, the terms "first," "second," and other expressions are not used to limit the sequence and quantity of assemblies, unless otherwise specified.

In order to realize an automatic flushing function of a urinal after use, inductors with various induction modes have been developed to meet different usage needs. Among them, the most traditional technology is to provide an infrared sensor on the urinal, an operating principle of which is that the infrared transmitter emits infrared rays of a certain wavelength, the infrared rays are reflected by a human body or object approaching the urinal, and then an infrared receiver receives the infrared rays and judges the strength of a reflected signal to realize automatic induction flushing. Generally, the infrared sensor is arranged in an additionally-disposed space on the urinal, and factors such as wiring layout need to be considered. In addition, it has been realized that an infrared induction manner is susceptible to environmental impact, may not accurately determine the existence of a target object, easily causes false flushing, and results in the waste of water resources.

In some manners that adopt inductors capable of accurately judging whether to carry out flushing, for example, capacitive inductors or conductance (or inductance) inductors, due to the increase in costs of the inductors, urinals with such inductors may not be widely used, which limits the product universality. Moreover, such inductors are generally disposed to be in contact with liquid in the urinal, resulting in the deposition of dirt, thereby affecting the detection performance, which is not conducive to later use and maintenance.

Therefore, the present utility model aims to provide a modularized induction flushing device. By modularization of induction assemblies, induction modules with different induction modes, for example, at least two of an infrared induction assembly, a conductance induction assembly, and a capacitive induction assembly, are replaced based on different needs, so that a urinal is suitable for various occasions.

Figure 10:
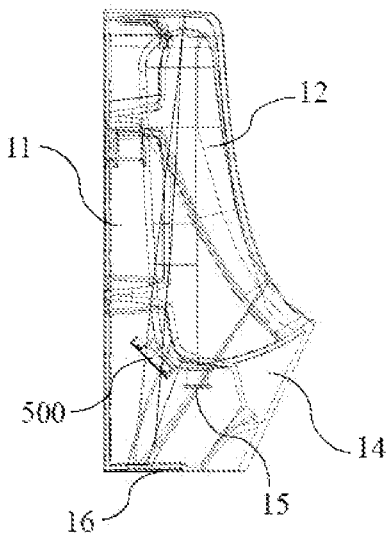
FIG. 10 is a side sectional view of the induction urinal shown in FIG. 5, showing a mounting position of the conductance induction assembly.
Figure 11:
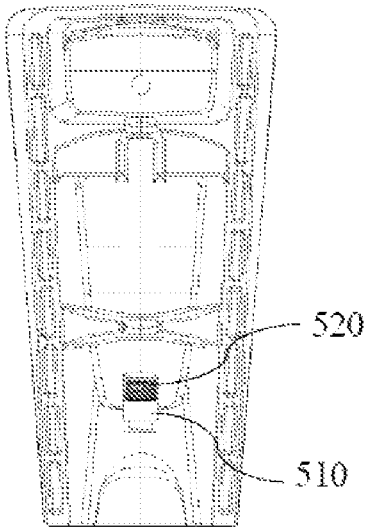
FIG. 11 is a back sectional view of the induction urinal shown in FIG. 5; showing a mounting position of the conductance induction assembly.

FIG. 1 exemplarily shows a urinal 10 in one structural form. The urinal is made of; for example, ceramics, and comprises a urinal body 11. However, a structure/size/shape of the urinal is not limited thereto. Generally, as shown in FIG. 10, an inner cavity 12 for containing liquid is formed in the urinal with an automatic flushing function, an inner wall of the inner cavity 12 is provided with an opening 13 for mounting a flushing nozzle, and an opening is formed at a bottom end to provide an accommodating cavity 14 for accommodating a control assembly. In some cases, a cover board 16 is further arranged to open or close the accommodating cavity 14. Herein, a back side of the urinal refers to a side, used for being mounted to a wall, of the urinal, a front side refers to a side facing a user, and when the inner cavity 12 and the accommodating cavity 14 are described, inner walls refer to sides facing interiors of the cavities.

Figure 2:
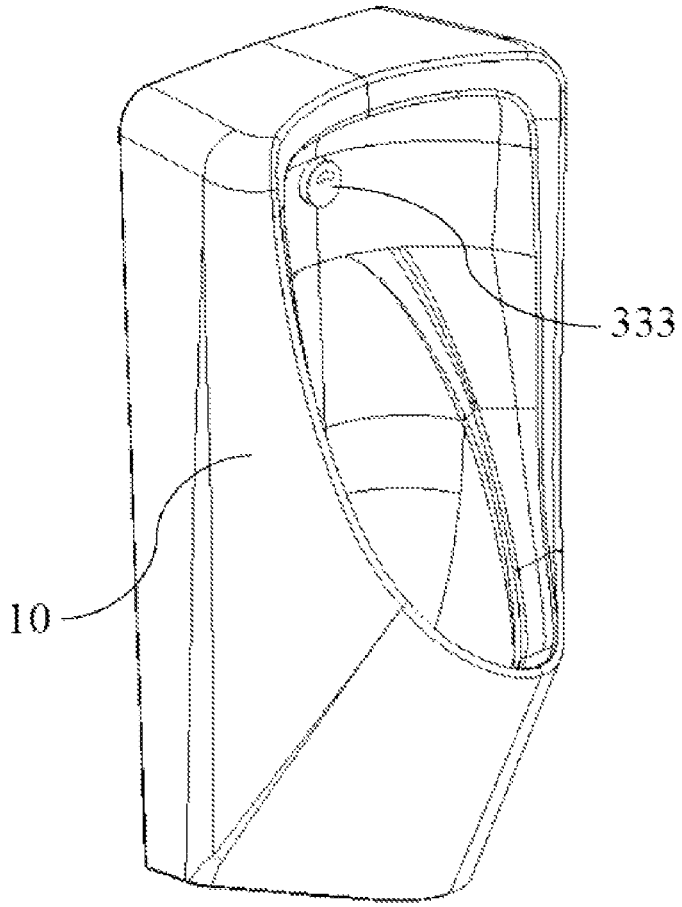
FIG. 2 is a schematic diagram of an induction urinal according to a first embodiment of the present utility model.
Figure 3:
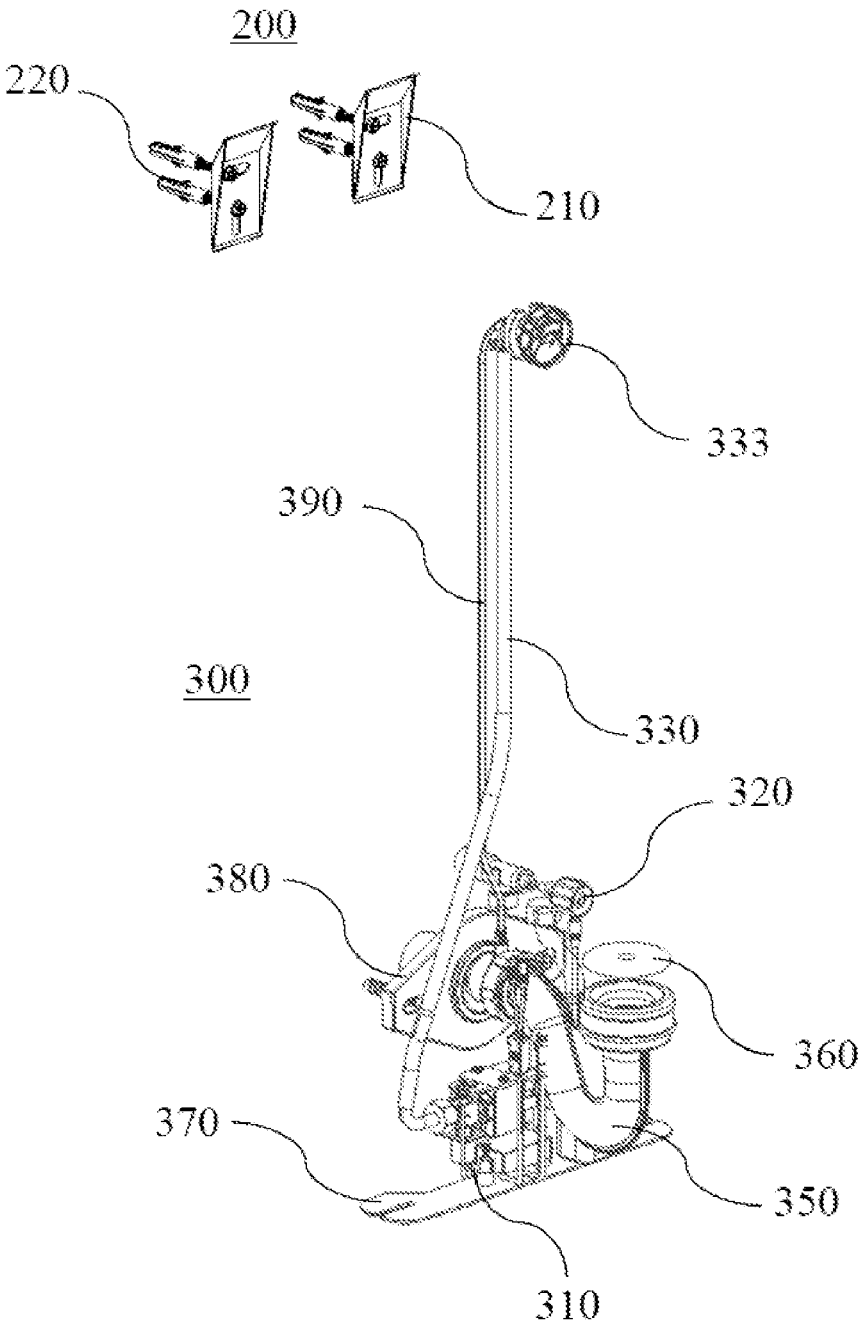
FIG. 3 is a schematic diagram of a modularized induction flushing device in the induction urinal shown in FIG. 2, and shows a mounting assembly for mounting a urinal body to a wall.
Figure 4:
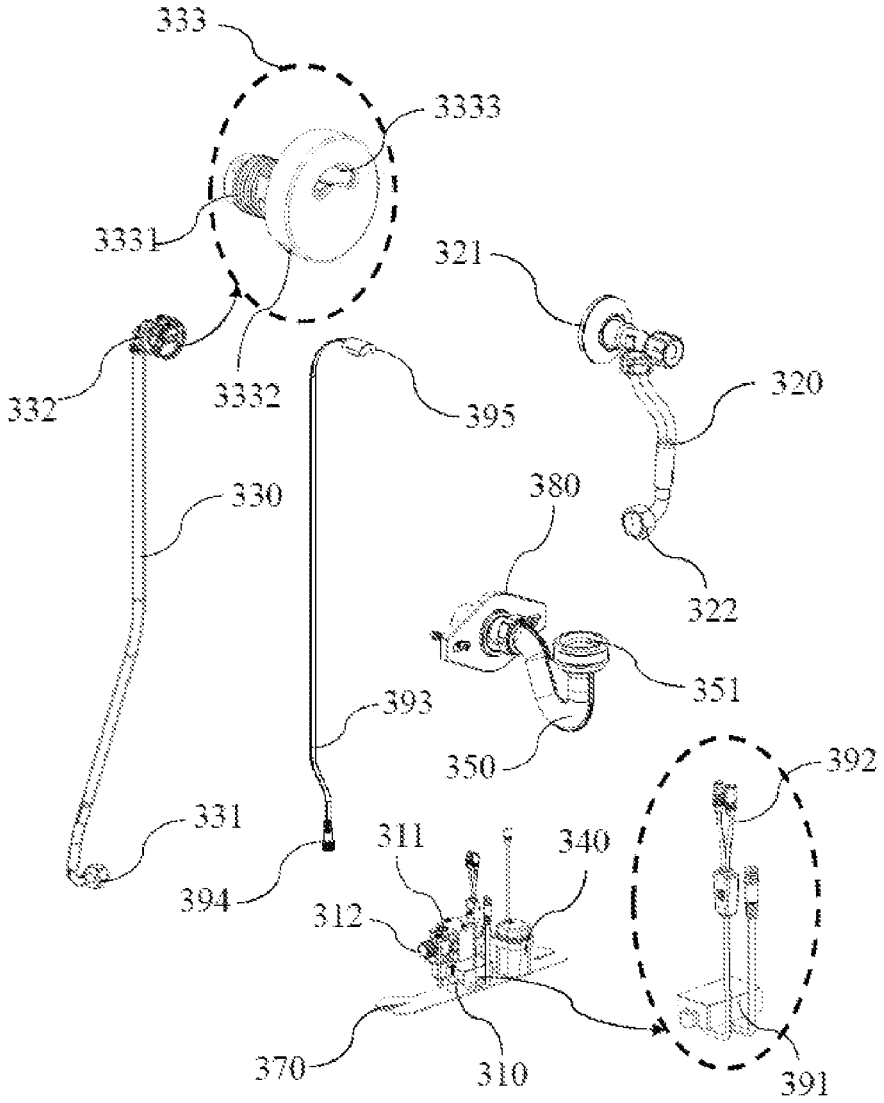
FIG. 4 is an exploded schematic diagram of the modularized induction flushing device shown in FIG. 3 and an enlarged schematic diagram of some components.
Figure 5:
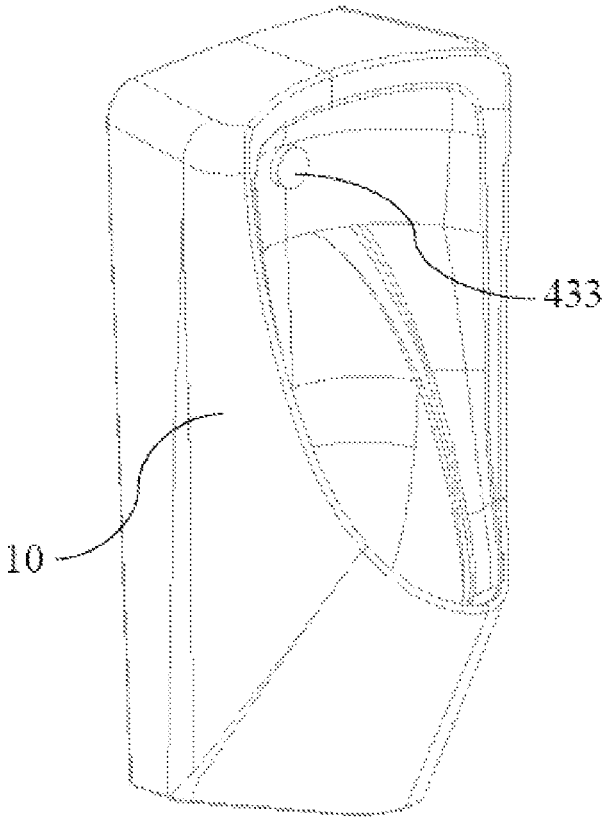
FIG. 5 is a schematic diagram of an induction urinal according to a second embodiment of the present utility model.
Figure 6:
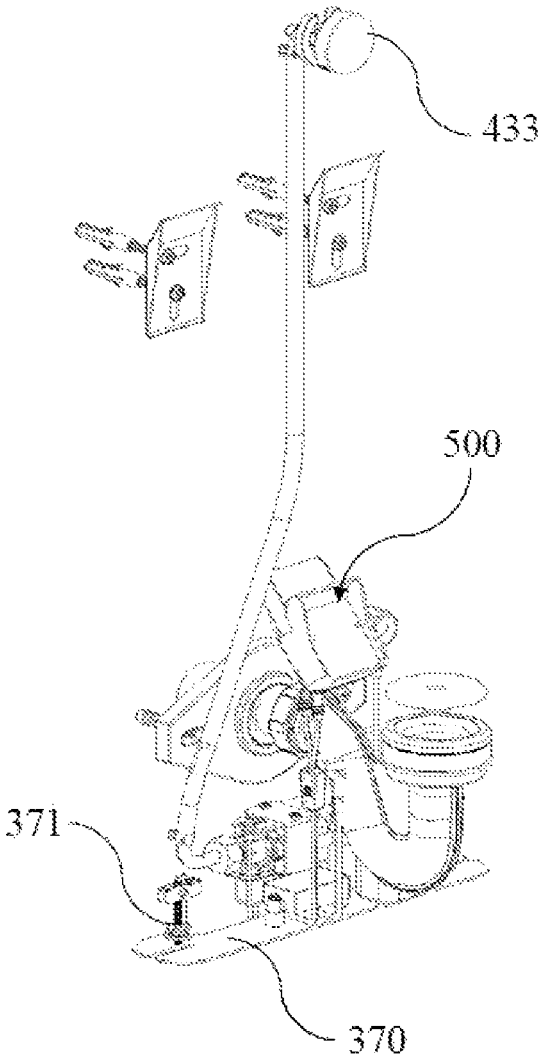
FIG. 6 is a schematic diagram of a modularized induction flushing device in the induction urinal shown in FIG. 5, and shows a mounting assembly for mounting a urinal body to a wall.

In combination with the first embodiment shown in FIG. 2 to FIG. 4, the urinal 10 is fixed to the wall through a mounting assembly 200. The mounting assembly 200 comprises, for example, a pair of mounting pads 210 and corresponding fasteners, such as fastening bolts 220. A modularized induction flushing device 300 according to the present utility model is assembled within the accommodating cavity of the urinal, and comprises a water inlet and outlet assembly, a water drainage assembly 350, an electromagnetic valve assembly 310, and a power supply assembly 340, wherein the electromagnetic valve assembly 310 controls opening and closing of a waterway, and comprises an electromagnetic valve 311, a water inlet connector (not shown) and a water outlet connector 312 connected with the electromagnetic valve 311. The power supply assembly 340 is an external AC power supply or a DC battery box, and is connected with the electromagnetic valve assembly 310 via wires to provide power. The water inlet and outlet assembly comprises a water inlet pipe 320 and a water outlet pipe 330. The water inlet pipe 320 has a first water inlet end 321 to be connected with an external water pipe and a first water outlet end 322 to be connected with the water inlet connector. The water outlet pipe 330 has a second water inlet end 331 connected with the water outlet connector 312 and a second water outlet end 332 connected with a flushing nozzle 333. As shown in FIG. 4, the flushing nozzle 333 is removably connected with the second water outlet end 332 through a connecting end 3331, and is at least provided with a flushing opening 3332. Since the flushing nozzle 333 is arranged on an upper portion of the urinal 10, the flushing opening 3332 is arranged facing the inner cavity 12 below.

Figure 13:
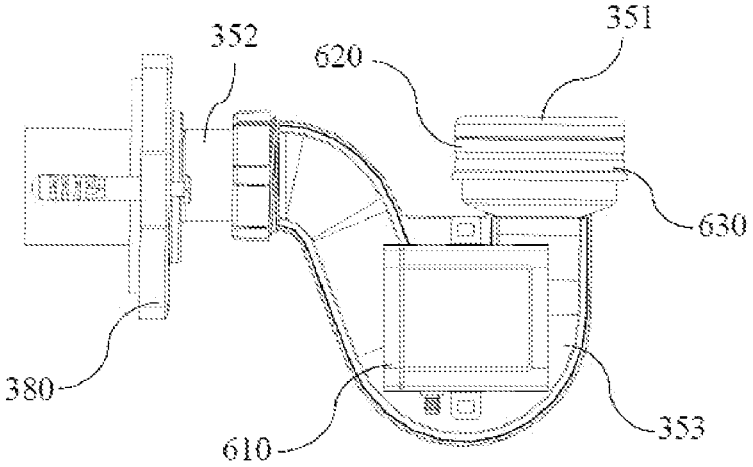
FIG. 13 is similar to FIG. 12 and shows a schematic plan view at an angle of view from one side of the capacitive induction assembly.

In combination with what is shown in FIG. 4 and FIG. 13, the water drainage assembly 350 comprises a water inlet port 351, a water drainage port 352, and an elbow 353 connected between the water inlet port and the water drainage port, wherein the water inlet port 351 is connected with an outer portion of a water drainage pipe opening 15 (FIG. 10) of the urinal in a sealed manner, and is generally provided with a sealing rubber gasket 360 (FIG. 3). The elbow 353 is used for storing water to achieve a deodorization effect.

In the first embodiment, as shown in FIG. 4, an induction module is an infrared induction assembly 390, and comprises an infrared induction controller 391 connected with the electromagnetic valve assembly 310, and an infrared induction probe 393 connected with the infrared induction controller 391 through a wire 392. The infrared induction probe 393 is attached to the water inlet and outlet assembly. Specifically, the infrared induction probe 393 has a power supply end 394 connected with the wire 392 and an induction end 395 attached to the flushing nozzle 333, wherein the flushing nozzle 333 is provided with a slot 3333 allowing the induction end 395 to be exposed, so as to be used for providing an induction window under an infrared induction mode.

In this embodiment, since the induction end of the infrared induction probe is integrated at the position of the flushing nozzle, and interference with the water outlet pipe 330 is avoided during mounting and use, space at the position of the flushing nozzle and within the accommodating cavity of the urinal is utilized advantageously without affecting the flushing performance, and no additional mounting space is required to be configured for the infrared induction probe. In addition, the position of the infrared induction probe also corresponds to the regular use position of a user, and induction and detection are more accurate. After a sensing signal is transmitted to the infrared induction controller, the infrared induction controller transmits a signal to the electromagnetic valve assembly connected thereto, and then the electromagnetic valve assembly controls a flushing valve to open for implementing flushing. Thus, an existing urinal with the infrared induction mode is improved at the least cost.

As mentioned above, the concept of the present utility model lies in the replaceability of the induction module/induction mode. On the basis that the first embodiment meets the usage needs of most users, a modularized universal urinal may be obtained by means of the modularized induction flushing device according to the present utility model by replacing different induction assemblies and/or flushing nozzles.

Referring to the second embodiment shown in FIG. 5 to FIG. 11 below, the difference from the above embodiment lies in the difference of the induction assembly and the flushing nozzle, so the same components will not be described again.

In this embodiment, the induction module is a conductance induction assembly 500, and the conductance induction assembly comprises a conductance inductor 520 connected with the electromagnetic valve assembly. In some embodiments, the conductance inductor 520 is advantageously integrated with electrodes so that a sensing signal may be transmitted to the electromagnetic valve assembly by, for example, a wireless communication manner without the need for additional arrangement of wires. As shown in FIG. 10, the conductance induction assembly 500 is adapted to be attached to an inner wall of a back side of the urinal adjacent to the water drainage assembly through, for example, a manner of an adhesive, and the conductance induction assembly is not in contact with the liquid in the urinal. It is known that the inductive conductivity of water is different from that of urine. The urine, which contains salt, has a higher conductivity, so it is easier to detect the difference between the water and the urine using the conductance induction mode. It should be understood that although the urine is used as a detected substance for distinguishing clear water in the liquid in the urinal, the present utility model may also be applied to the detection of other dirt such as excrement or vomit.

In the shown embodiment, the conductance induction assembly is conveniently attached to the inner wall of the back side of the urinal adjacent to the water drainage assembly by a bonding manner; and when a user uses the urinal, whether there is urine flowing on a wall surface of the inner cavity of the urinal may be accurately sensed, thereby providing a sensing signal to the electromagnetic valve assembly to realize flushing. For liquids such as clear water or a toilet cleaner used for cleaning the urinal, the conductance induction assembly may not be triggered to generate a signal, and waste of water resources caused by false flushing is avoided. Under this induction mode, the conductance induction assembly adopts a manner of in no contact with the liquid, which avoids the problem of inductive failure, especially of the conductance inductor, caused by the dirt. In some embodiments, if the water drainage assembly is clogged due to, for example, too much dirt, the conductance induction assembly arranged adjacent to the water drainage assembly may also sense and detect a change in conductivity to provide an accurate signal for the electromagnetic valve assembly, so that the use comfort of the user will not be affected by water overflow or splashing caused by continuous flushing.

Figure 8:
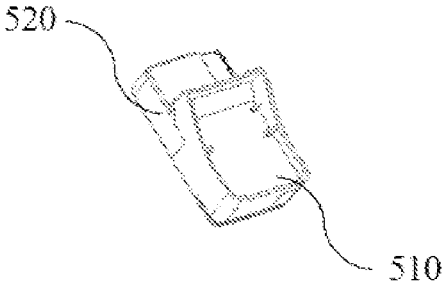
FIG. 8 is a schematic diagram of a conductance induction assembly in the modularized induction flushing device shown in FIG. 6.
Figure 9:
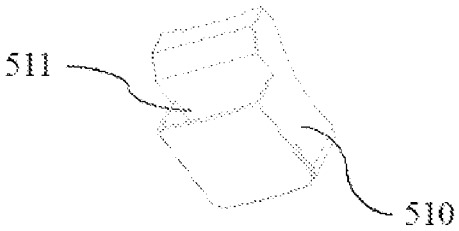
FIG. 9 is a schematic diagram of an inductor bracket in the conductance induction assembly shown in FIG. 8.

In some embodiments, the conductance induction assembly 500 further comprises an inductor bracket 510. In combination with what is shown in FIG. 8 and FIG. 9, the inductor bracket 510 is provided with a clamping groove 511 for accommodating the conductance inductor 520, and may be attached to the inner wall of the back side of the urinal through an adhesive. Advantageously, the inductor bracket 510 has an outer surface fitting with a profile of the inner wall of the back side of the urinal, so that the conductance induction assembly clings to the inner wall of the back side of the urinal. Under this manner, the conductance inductor 520 is removably accommodated within the clamping groove 511, or the clamping groove 511 may be filled with glue, so that there is no gap between the conductance inductor and the wall surface to be sensed to ensure the accuracy of detection results. By the adoption of a removable mounting manner of the conductance inductor 520, in the case that the conductance inductor 520 fails and needs to be replaced, it is convenient to remove the conductance inductor 520 from the inductor bracket 510, while the inductor bracket 510 is kept on the urinal for use by a new conductance inductor after replacement.

Figure 7:
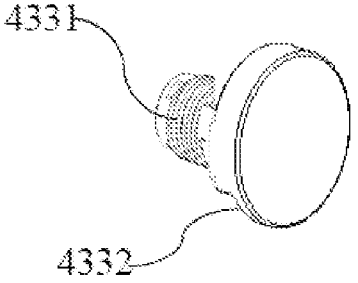
FIG. 7 is a schematic diagram of a flushing nozzle in the modularized induction flushing device shown in FIG. 6.

By the adoption of the conductance induction mode, the deficiency that the infrared induction mode requires an induction window and the defect of induction failure are overcome, and the conductance induction mode has the advantages of high detection sensitivity and fast response. Due to the characteristic that the conductance induction assembly is easy to remove and mount, a user may perform replacement by himself before or after the modularized induction flushing device is assembled to the urinal, so as to update the urinal or superimpose different induction modes. For example, when the user desires to superimpose two induction modes, only the conductance induction assembly needs to be bonded to the inner wall of the back side of the urinal, which is quick and convenient, so that the deficiency of the infrared induction assembly may be made up by the conductance induction assembly. In the embodiment that only the conductance induction mode is adopted, the flushing nozzle 333 of the first embodiment shown in FIG. 3 may be replaced with a flushing nozzle 433 of the second embodiment shown in FIG. 6. As shown in FIG. 7, the flushing nozzle 433 also has a connecting end 4331 connected to the water outlet pipe, and a flushing opening 4332 facing downward, but does not have the induction window. Therefore, the user only needs to replace the flushing nozzle to cover the infrared induction probe, and then bond the conductance induction assembly 500 to the inner wall of the back side of the urinal, or optionally remove the infrared induction assembly, and the whole flushing device does not require to be replaced, thereby being cost-effective.

Figure 12:
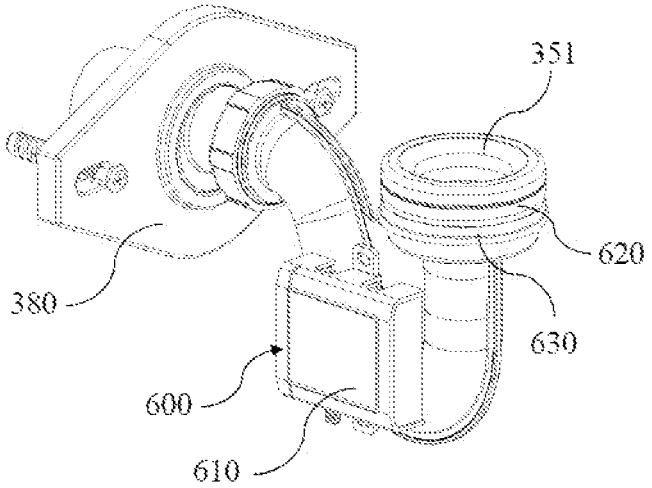
FIG. 12 is a schematic diagram of a capacitive induction assembly mounted to a water drainage assembly in an induction urinal according to a third embodiment of the present utility model.

FIG. 12 to FIG. 13 show the third embodiment of the present utility model. Similarly, the difference between this embodiment and the above-mentioned embodiments lies in the difference of the induction assembly, so the same components are not shown and the same description is not repeated.

In this embodiment, the induction module is a capacitive induction assembly 600. The capacitive induction assembly comprises a capacitive inductor 610 connected with the electromagnetic valve assembly and electrodes connected with the capacitive inductor. The capacitive inductor 610 is removably bonded to the water drainage assembly, for example, directly to the elbow 353 by adhesive tape or hook and loop fasteners, so as to facilitate fixation during use and removal during later maintenance and replacement. The electrodes are attached to the water inlet port 351 of the water drainage assembly by, for example, adhesive tape, and preferably at least two electrodes are arranged in sequence along the water drainage direction. The figures exemplarily show a first electrode 620 and a second electrode 630 affixed to the position of the water inlet port 351 of the water drainage assembly. Only when the two electrodes receive a fixed signal pulse simultaneously, is the control triggered to realize an anti-interference function. Advantageously, the electrodes are arranged on an outer wall of the water inlet port 351, thereby being in no contact with the liquid in the urinal and avoiding induction failure caused by dirt.

Figure 14:
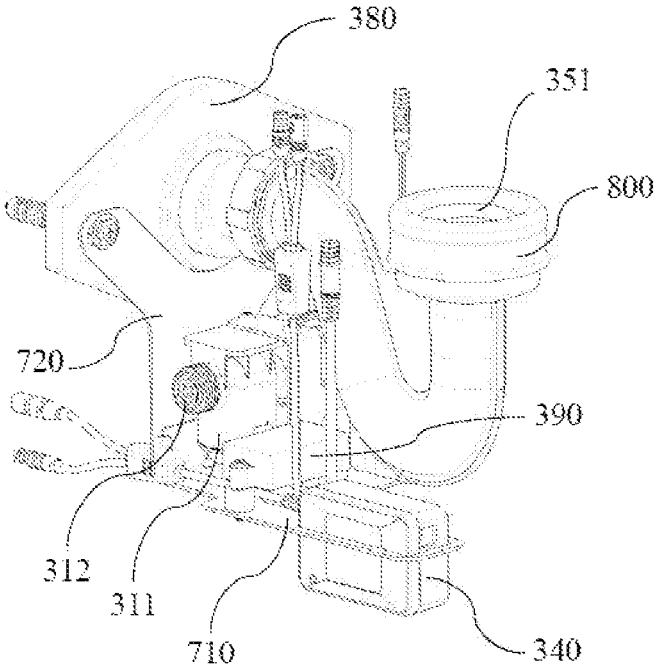
FIG. 14 is a schematic diagram of fixing a modularized induction flushing device to a wall according to an embodiment of the present utility model.
Figure 15:
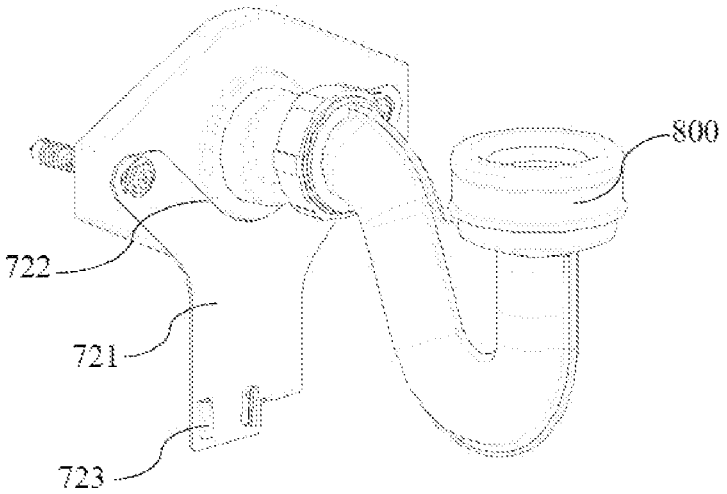
FIG. 15 is a schematic diagram with some assemblies removed from FIG. 14 and shows a connecting frame fixed to a mounting plate.

As shown in FIG. 14 and FIG. 15, a sealing plug, such as a rubber plug 800, is arranged at a connection position of the water inlet port 351 of the water drainage assembly and the water drainage pipe opening 15 of the urinal. The rubber plug 800 plays a role in sealing between the plastic water drainage assembly and the ceramic urinal. Meanwhile, the rubber plug 800 also wraps the aforementioned first electrode 620 and second electrode 630 from an outside to prevent water and moisture from entering the electrodes and affecting a capacitive induction signal, thereby improving the operating stability and reliability of the inductor.

It is known that solutes of the water and the urine are different, and whether there is water in the elbow may also affect the capacitance of the solutes. The capacitive induction mode is adapted to accurately sense a change in the solute of urine, and is adapted to sense whether the position of the water drainage assembly is clogged, so as to avoid overflow. When the dirt flows into the elbow 353 through the water inlet port 351 of the water drainage assembly and causes a change in the solute capacitance of the liquid in the elbow 353, the capacitive induction assembly transmits a signal to the electromagnetic valve assembly after sensing a change signal, thereby controlling the flushing valve to open for implementing flushing. When water remains stationary and reaches a level similar to submerging the electrodes, a sensing signal may also be obtained, and it will not continue to flush and cause overflow.

Similarly, depending on different application scenarios and/or user needs, the capacitive induction assembly of this embodiment is also adapted to be used in substitution or in superposition with the above-mentioned infrared induction assembly and/or conductance induction assembly.

In addition to the replaceability design of the induction module, the present utility model also improves a fixing manner of the modularized induction flushing device in the urinal. Generally, the electromagnetic valve assembly and the power supply assembly are mounted in an accommodating chamber of the back side of the urinal, the accommodating chamber is located at a bottom of the urinal body, and there is a problem of inconvenience to remove and mount when maintenance or replacement is required.

Going back to FIG. 3 and FIG. 4, it may be seen that the water drainage port of the water drainage assembly 350 penetrates through a mounting plate 380 to communicate with an external sewage pipeline, and the mounting plate 380 is fixed to the wall by, for example, fasteners such as screws. In the embodiment shown in the figures, the electromagnetic valve assembly 310, the power supply assembly 340, and, for example, the infrared induction assembly 390 are assembled on a bracket 370 to be integrated into a single module. The bracket 370 may be directly fixed to the inner wall of the back side of the urinal, for example, the cover board 16, by, for example, screws 371, to facilitate removal for realizing maintenance operations such as battery replacement.

Figure 16:
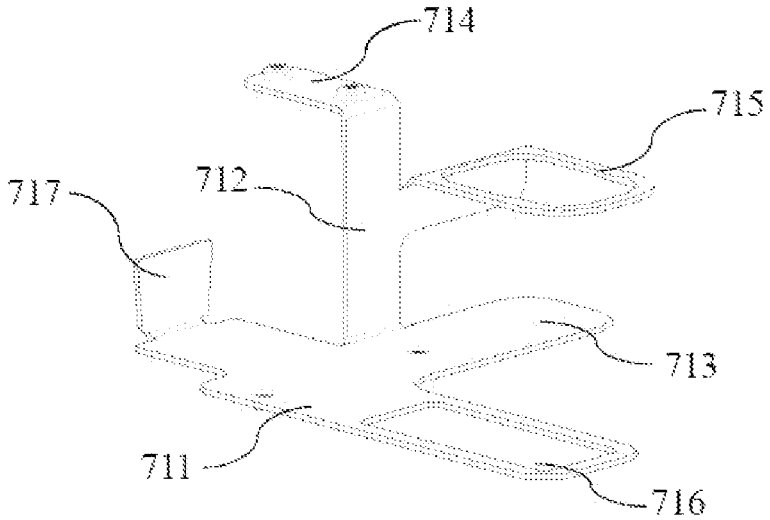
FIG. 16 is a schematic diagram of a bracket matched with the connecting frame in FIG. 14.

In some embodiments, as shown in FIG. 14 to FIG. 16, the bracket may be fixed to the mounting plate through a connecting frame. Specifically, the bracket 710 in this embodiment comprises a bottom board 711 and at least one support board extending out from the bottom board 711 in parallel and/or at an angle, for example, a first support board 713 extending out from the bottom board 711 in parallel and a second support board 712 extending out from the bottom board vertically, as shown in FIG. 16. Each support board is provided with a support cantilever 714 and/or support buckles 715 and 716 extending out approximately parallel to the bottom board 711, so as to be used for fixing the electromagnetic valve assembly, the power supply assembly, and/or the induction module. In this manner, the above-mentioned assemblies are integrated into a module through the bracket, and the connecting frame 720 is combined as shown in FIG. 14 to simplify removal and improve efficiency.

The fixing between the bracket and the connecting frame may be selected as fastener connection, bonding, clamping, or other appropriate manners. In some embodiments, as shown in FIG. 15, the connecting frame 720 is configured as a connecting board 721 fixed to the mounting plate 380 in an attached manner through fasteners, for example, screws, and is provided with a pair of clamping ribs 723 protruding out from the connecting board 721. Correspondingly, the bracket 710 comprises mounting lugs 717 extending out from the bottom board 711 at an angle to be removably clamped into a pair of clamping ribs 723. Optionally, the connecting frame 720 is configured to be in a Y shape and comprises a notch 722 for forming avoidance with the water drainage assembly.

Through the above-mentioned improvement of the fixing manner of the modularized induction flushing device, when the electromagnetic valve assembly, the power supply assembly, and/or the infrared induction controller needs to be maintained or replaced, only the bracket needs to be removed, and the operation is convenient. Thus, the modularized induction flushing device of the present utility model is adapted to more diversified product designs.

It should be understood here that the embodiments shown in the drawings only show alternative configurations, shapes, sizes, and arrangement forms of the optional components of the modularized induction flushing device according to the present utility model, which however are only illustrative rather than limiting, and that other shapes, sizes, and arrangement forms may also be adopted without departing from the spirit and scope of the present utility model.

The technical contents and technical features of the present utility model have been disclosed above. However, it may be understood that a person skilled in the art may make various changes and modifications to the disclosed concept under the inventive idea of the present utility model, all of which fall within the protection scope of the present utility model. The above description of the embodiments is intended to be illustrative rather than restrictive, and the protection scope of the present utility model is defined by the appended claims.

The invention claimed is:

1. A modularized induction flushing device for a urinal, comprising a water inlet and outlet assembly, a water drainage assembly, an electromagnetic valve assembly, and a power supply assembly, wherein the modularized induction flushing device further comprises an induction module, the induction module is associated with the electromagnetic valve assembly and attached to the water inlet and outlet assembly and/or the water drainage assembly, the induction module is configured to be switched between at least two induction modes in a replaceable manner, and the electromagnetic valve assembly responds to different induction modes of the induction module to control flushing of the urinal.

2. The modularized induction flushing device according to claim 1, wherein the induction module comprises at least two of an infrared induction assembly, a conductance induction assembly, and a capacitive induction assembly.

3. The modularized induction flushing device according to claim 2, wherein the water inlet and outlet assembly comprises a water inlet pipe connected with the electromagnetic valve assembly, a water outlet pipe, and a flushing nozzle removably connected with the water outlet pipe, and the flushing nozzle is adapted to be arranged on an upper portion of the urinal and is at least provided with a flushing opening.

4. The modularized induction flushing device according to claim 3, wherein the induction module comprises an infrared induction assembly comprising an infrared induction controller connected with the electromagnetic valve assembly, and an infrared induction probe connected with the infrared induction controller, wherein the infrared induction probe is attached to the water inlet and outlet assembly.

5. The modularized induction flushing device according to claim 4, wherein the infrared induction probe is attached to the flushing nozzle, and the flushing nozzle is provided with a slot allowing the infrared induction probe to be exposed.

6. An induction urinal, comprising a urinal body and the modularized induction flushing device for the urinal according to claim 4, wherein before or after the modularized induction flushing device is assembled to the urinal body, the induction module is attached to the water inlet and outlet assembly and/or the water drainage assembly in a replaceable manner, so as to realize switching of at least two induction modes.

7. The modularized induction flushing device according to claim 2, wherein the induction module comprises a conductance induction assembly comprising a conductance inductor connected with the electromagnetic valve assembly, wherein the conductance inductor is adapted to be attached to an inner wall of a back side of the urinal adjacent to the water drainage assembly, and is not in contact with liquid in the urinal.

8. The modularized induction flushing device according to claim 7, wherein the conductance induction assembly further comprises an inductor bracket, the inductor bracket is provided with a clamping groove for accommodating the conductance inductor, and is attached to the inner wall of the back side of the urinal through an adhesive, the conductance inductor is removably accommodated within the clamping groove through an adhesive, and the inductor bracket has an outer surface fitting with a profile of the inner wall of the back side of the urinal.

9. An induction urinal, comprising a urinal body and the modularized induction flushing device for the urinal according to claim 7, wherein before or after the modularized induction flushing device is assembled to the urinal body, the induction module is attached to the water inlet and outlet assembly and/or the water drainage assembly in a replaceable manner, so as to realize switching of at least two induction modes.

10. The modularized induction flushing device according to claim 2, wherein the induction module comprises a capacitive induction assembly comprising a capacitive inductor connected with the electromagnetic valve assembly, and electrodes connected with the capacitive inductor, the capacitive inductor is removably bonded to the water drainage assembly, and the electrodes are attached to an outer wall of a water inlet port of the water drainage assembly and are not in contact with the liquid in the urinal.

11. The modularized induction flushing device according to claim 10, wherein the capacitive induction assembly comprises at least two electrodes arranged in sequence along a water drainage direction.

12. The modularized induction flushing device according to claim 10, wherein the water drainage assembly further comprises a sealing plug disposed between the outer wall of the water inlet port and a water drainage pipe opening of the urinal, and the sealing plug covers the electrodes.

13. An induction urinal, comprising a urinal body and the modularized induction flushing device for the urinal according to claim 10, wherein before or after the modularized induction flushing device is assembled to the urinal body, the induction module is attached to the water inlet and outlet assembly and/or the water drainage assembly in a replaceable manner, so as to realize switching of at least two induction modes.

14. The modularized induction flushing device according to claim 1 wherein the modularized induction flushing device further comprises a mounting plate adapted to be fixed to a wall, and the water drainage assembly communicates with a sewage pipeline via the mounting plate, wherein the electromagnetic valve assembly, the power supply assembly, and/or the induction module are directly fixed to the inner wall of the back side of the urinal through a bracket, or the bracket is fixed to the mounting plate through a connecting frame.

15. The modularized induction flushing device according to claim 14, wherein the bracket comprises a bottom board and at least one support board extending out from the bottom board in parallel and/or at an angle, and the support board is provided with a support cantilever and/or support buckles extending out approximately parallel to the bottom board, so as to be used for fixing the electromagnetic valve assembly, the power supply assembly, and/or the induction module.

16. The modularized induction flushing device according to claim 15, wherein the connecting frame is configured as a connecting board fixed to the mounting plate in an attached manner, and is provided with a pair of clamping ribs protruding out from the connecting board, the bracket comprises mounting lugs extending out from the bottom board at an angle, and the mounting lugs are adapted to be removably clamped into the pair of clamping ribs.

17. The modularized induction flushing device according to claim 16, wherein the connecting frame is configured to be in a Y shape and comprises a notch for forming avoidance with the water drainage assembly.

18. An induction urinal, comprising a urinal body and the modularized induction flushing device for the urinal according to claim 1, wherein before or after the modularized induction flushing device is assembled to the urinal body, the induction module is attached to the water inlet and outlet assembly and/or the water drainage assembly in a replaceable manner, so as to realize switching of at least two induction modes.

* * * * *